US006857804B2

(12) United States Patent
Luciano, Jr. et al.

(10) Patent No.: US 6,857,804 B2
(45) Date of Patent: Feb. 22, 2005

(54) VERTICALLY MOUNTED MODULAR PRINTER SYSTEM

(75) Inventors: Robert A. Luciano, Jr., Reno, NV (US); Kurt W. Spencer, Reno, NV (US); Michael J. Souza, Reno, NV (US); Timothy F. Kelley, Reno, NV (US); Robert S. Anderson, Reno, NV (US)

(73) Assignee: Sierra Design Group, Reno, NV (US)

( * ) Notice: Subject to any disclaimer, the term of this patent is extended or adjusted under 35 U.S.C. 154(b) by 181 days.

(21) Appl. No.: 10/090,115

(22) Filed: Feb. 27, 2002

(65) Prior Publication Data

US 2002/0146271 A1 Oct. 10, 2002

Related U.S. Application Data

(63) Continuation-in-part of application No. 09/420,222, filed on Oct. 16, 1999, now Pat. No. 6,443,642.

(51) Int. Cl.[7] ..... G07F 9/00

(52) U.S. Cl. ..... 400/691; 400/88; 400/693; 902/18; 902/30; 902/31; 235/379

(58) Field of Search ..... 400/88, 691, 693, 400/692; 902/22, 18, 26, 30, 27, 31, 32, 33, 34, 35, 36; 235/379

(56) References Cited

U.S. PATENT DOCUMENTS 4,265,552 A * 5/1981 Bemis et al. ..... 400/236
4,881,839 A 11/1989 Grimm
5,039,242 A 8/1991 Johnson
5,180,232 A 1/1993 Chadima, Jr. et al.
5,356,231 A 10/1994 Nakamura et al.
5,442,567 A * 8/1995 Small ..... 700/237
5,483,047 A * 1/1996 Ramachandran et al. ... 235/379
5,593,149 A * 1/1997 Kimura et al. ..... 271/3.01
5,788,348 A * 8/1998 Ramachandran et al. 312/223.1
6,042,285 A 3/2000 Faes et al.
6,088,222 A 7/2000 Schmitt et al.
6,125,028 A 9/2000 Matsumoto
6,278,472 B1 8/2001 Sasaki et al.

FOREIGN PATENT DOCUMENTS

JP 09-153916 6/1999

* cited by examiner

*Primary Examiner*—Andrew H. Hirshfeld
*Assistant Examiner*—Kevin D. Williams
(74) *Attorney, Agent, or Firm*—Ian F. Burns

(57) ABSTRACT

The present invention comprises a printer system for a device that comprises a secure compartment and a top surface displaced at an acute angle relative to a floor. A portion of the secure compartment includes interior of an opening from the top surface. The printer system comprises a support frame attachable to the device and displaced in the secure compartment of the device. The support frame comprises at least one glide rail. The printer system further comprises a printer assembly attached to the support frame. The printer assembly comprises a media holder adapted to hold printable media, a chassis intermediate and attached to the media holder, and a printer attached to the chassis and adapted to print on the media. In a first position, the printer assembly is displaced substantially inside the secure compartment. In a second position, the printer assembly is extended away from the secure compartment.

25 Claims, 12 Drawing Sheets

VERTICALLY MOUNTED MODULAR PRINTER SYSTEM

RELATED APPLICATIONS

This application is a continuation-in-part application of U.S. patent application Ser. No. 09/420,222, filed Oct. 16, 1999 now U.S. Pat. No. 6,443,642 and entitled, "Modular Printing System," the contents of which are herein incorporated by reference.

BACKGROUND OF THE INVENTION

1. Field of Invention

This invention relates to a vertically mounted printer for gaming devices that is used to print and present tickets or vouchers to a user of a gaming machine.

2. Description of Related Art

Gaming devices are designed with various shapes and dimensions in order to present entertaining information to a user and to be as ergonomically friendly to the user as possible. Games that are more ergonomically appealing will attract more players who will play for longer time periods. One configuration that is common to gaming machines is to present the user with controls and information on a top surface that is slanted upwardly away from the user. This surface is called a slant top surface. Typical slant top surfaces will have a variety of information presenting devices such as video screens, or spinning reels along with controls for the user such as buttons or joysticks. Prior art slant top gaming devices provide a coin box mounted on the slant top surface. The coin box receives coins or tokens from the user and signals the game to start operation. The coin box also stores the coins or tokens and can also act as a dispenser. When a user has won, the coin box can dispense the proper amount of winnings to a bin.

Unfortunately, coin boxes have many disadvantages. They are subject to frequent breakdowns and jamming. Coin boxes also require frequent filling and removal of coins which are heavy and inconvenient to handle. In response to these problems, operators of gaming devices have investigated the use of other kinds of currency media in order to dispense winnings to the user. Paper media such as vouchers, tickets, coupons, receipts, and game tokens have been used to replace coins. The amount of winnings and other information can be printed on the paper media at the time the media is dispensed to the user. This allows for more customization of the game and adds to the excitement of the game for the user.

Printers are now widely used to print various kinds of information bearing objects. In many applications, it is necessary to place printers in small inaccessible spaces. For example, if a printer is used in a gaming device, the printer must occupy a minimum amount of space so that it does not interfere with the operation of other devices. In this application, it is also important that a printer occupy a minimum amount of space on the front of the machine so that the space can be used to present information or entertaining graphics to the user. Printer must also appear as if originally constructed with the gaming device to add appeal to the user. It is also important that a printer be easily accessible for maintenance and to add more media to the printer. Another important function for a printer in a gaming device is to be readily replaceable. If the gaming device is inoperable, it is advantageous to be able to quickly replace the printer with a working unit. This minimizes down time and loss of revenue to the game operator.

It is desirable for printers for a slant top surface gaming device to present the printed media on the slanted top surface of the device while, at the same time, appearing as if originally constructed with the gaming device and occupying a minimal amount of space within the gaming device. Such demanding requirements present a difficult challenge to printer designers. The smaller a printer becomes, the more difficult it is to perform routine maintenance or to correct faults. The smaller the amount of space a printer occupies, the more difficult it is to access and remove the printer. What has long been needed is a printer that can be mounted on a slant top surface and occupies a minimum amount of space, yet is easily accessed and maintained. Another long felt need is a printer that can be easily added to space occupied by a coin box in existing gaming devices.

SUMMARY OF INVENTION

1. Advantages of the Invention

An advantage of the present invention is that it provides a printer system that is accessible for service and yet is readily secured.

Another advantage of the present invention is that it provides a printer system that allows media to be easily and quickly added to the to the system.

A further advantage of the present invention is that it provides a printer system for a device that can be quickly replaced in the event of a failure.

An additional advantage of the present invention is that it provides a printer system that can replace a coin box.

Yet another advantage of the present invention is that it provides a printer system that may be secured in a closed position.

Another advantage of the present invention is that it may be configured to provide a latch that enables it.

An advantage of the present invention is that it provides a printer system that uses a spring mechanism to move the printer away from the device that it is mounted in for easier removal.

These and other advantages of the present invention may be realized by reference to the remaining portions of the specification, claims, and abstract.

2. Brief Description of the Invention

The present invention comprises a printer system for a device that comprises a secure compartment and a top surface positioned at an acute angle relative to a floor. A portion of the secure compartment includes interior of an opening from the top surface. The printer system comprises a support frame attachable to the device and positioned in the secure compartment of the device. The support frame comprises at least one glide rail. The printer system further comprises a printer assembly attached to the support frame. The printer assembly comprises a media holder adapted to hold printable media, a chassis intermediate and attached to the media holder, and a printer attached to the chassis and adapted to print on the media. In a first position, the printer assembly is positioned substantially inside the secure compartment. In a second position, the printer assembly is extended away from the secure compartment.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENT

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made with out departing from the scope of the present invention.

Figure 1:
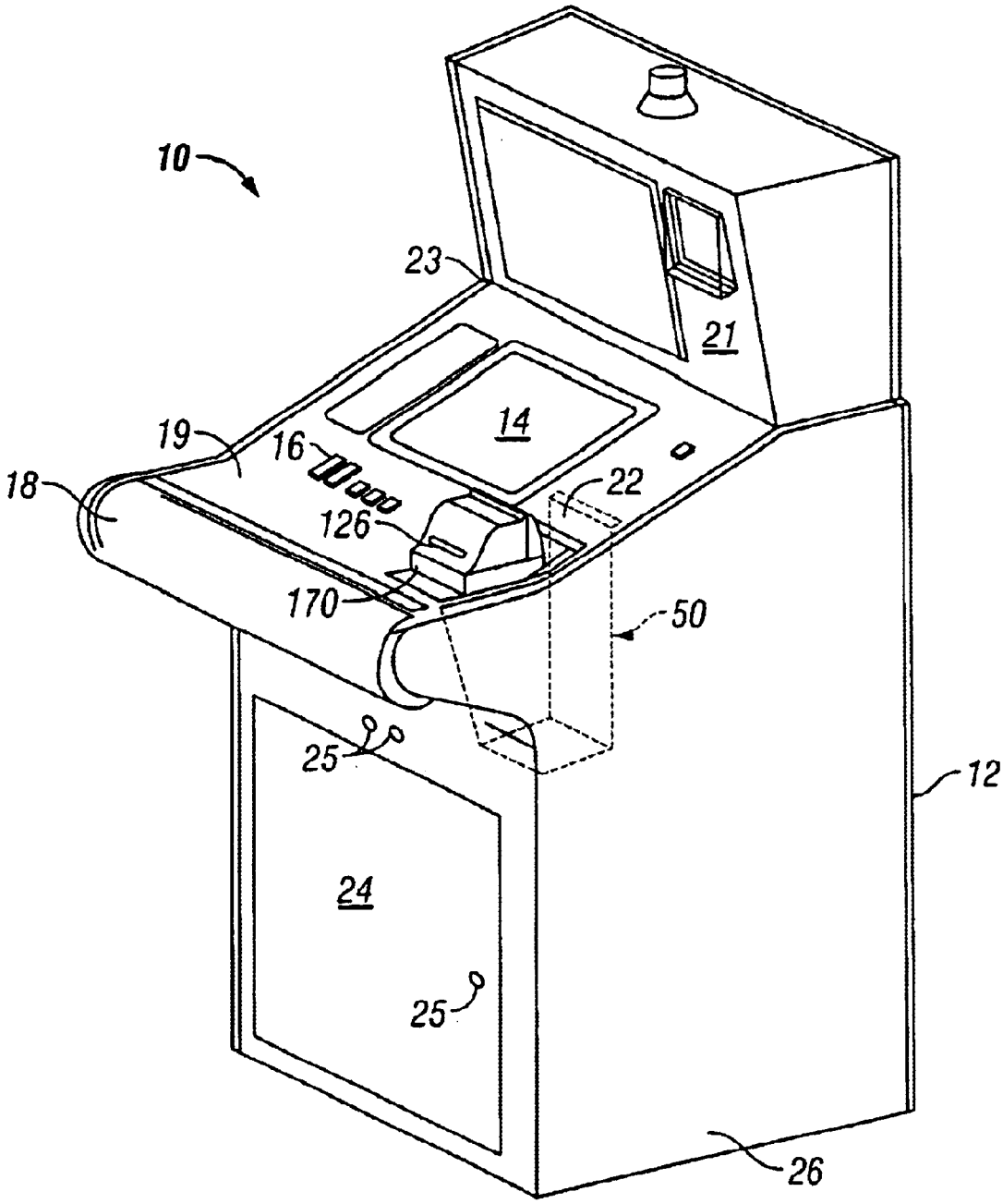
FIG. 1 is substantially a perspective view of the printer assembly of the present invention in a closed position in use with a gaming device having a secure compartment.

Referring now to FIG. 1, the present invention comprises printer system 50 that is adapted for use in secure device 10. Device 10 may be any device with a secure compartment 26, such as a gaming device or an automatic teller machine. Compartment 26 may hold any object or mechanism that is subject to theft, tampering, or unauthorized access. Device 10 comprises a case 12, a display 14, controls 16, and armrest 18. Device 10 may further comprise hopper, coin acceptor, and coin bucket (not shown). Display 14 can be a video display or a mechanical display, such as rotating reels. Controls 16 can be buttons or a joystick or other electrical or mechanical controls.

Case 12 comprises a slant top surface 19 and a vertical surface 21. Slant top surface 19 is positioned at an acute angle relative to a floor. Case 12 can be formed from sheet metal, wood, fiberglass, plastic, etc. Display 14 and controls 16 may be mounted on slant top surface 19. A rectangular opening 22 is located in slant top surface 19. In some prior art devices, opening 22 would be used to mount a coin box. Case 12 further comprises door 24 and locking mechanism 25. In the preferred embodiment, case 12 comprises slant top surface 19 pivotably attached to case 12 by hinge 23 (see also FIG. 10) or other fasteners known in the art. Thus, hinge 23 allows slant top surface 19 to serve as a door adapted to limit access to an object or mechanism that is subject to theft or tampering and that is secured within compartment 26, including printer system 50. Slant top surface 19 is adapted to swing upwardly away from display 14. When surface 19 is in an open position, it may be held up by a pneumatic strut or by a spring mechanism. Top surface 19 has several apertures 308 (see FIG. 9) to accommodate display 14 and controls 16 when slant top surface 19 is in a closed position. In another embodiment shown in FIG. 12, case 12 comprises bill validator 27 pivotably attached to case 12 by hinge 29 or other fasteners known in the art.

Locking mechanism 25 may be configured to lock and unlock access compartments including door 24, slant top surface 19, and bill validator 27. Locking mechanism 25 may be any lock device, such as a mechanical lock that is actuated by a key, an electronic lock that is actuated by an electronic key, or a combination of both. A separate locking mechanism 25 may be provided for each door or compartment.

Figure 2:
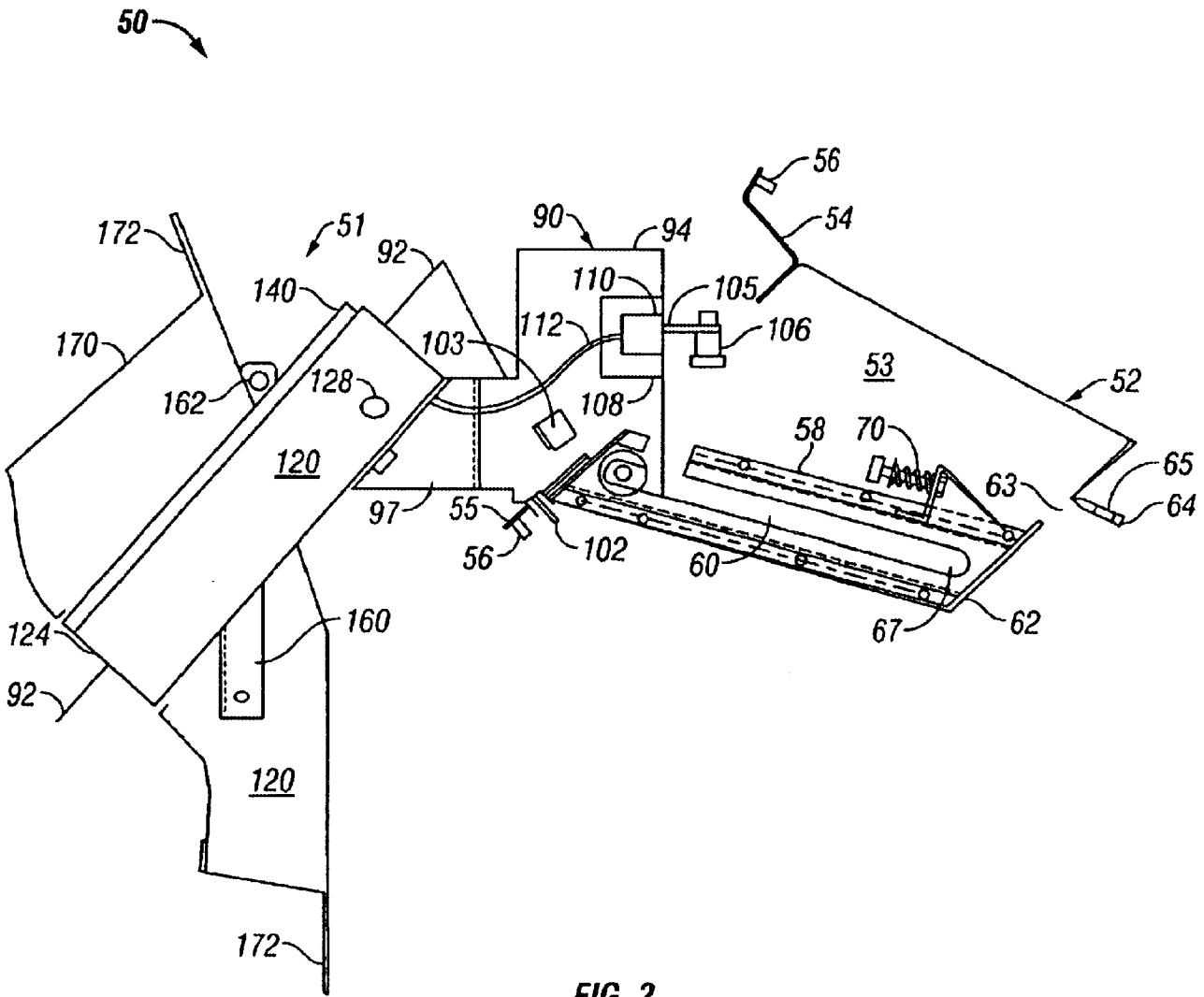
FIG. 2 is substantially a side cross-sectional view of one embodiment of the printer system of the present invention with the printer assembly slid out of the support frame in the open position.

Printer system 50 is mounted in opening 22. As shown in FIG. 1, printer system 50 occupies minimum amount of space. Printer system 50 may be used to replace coin boxes while at the same time appearing as if originally constructed with device 10. Referring now to FIG. 2, printer system 50 comprises a printer assembly 51, media holder 90, and support frame 52. Printer assembly 51 comprises printer 140, cover 170, and ticket opening 126.

Printer

Figure 3:
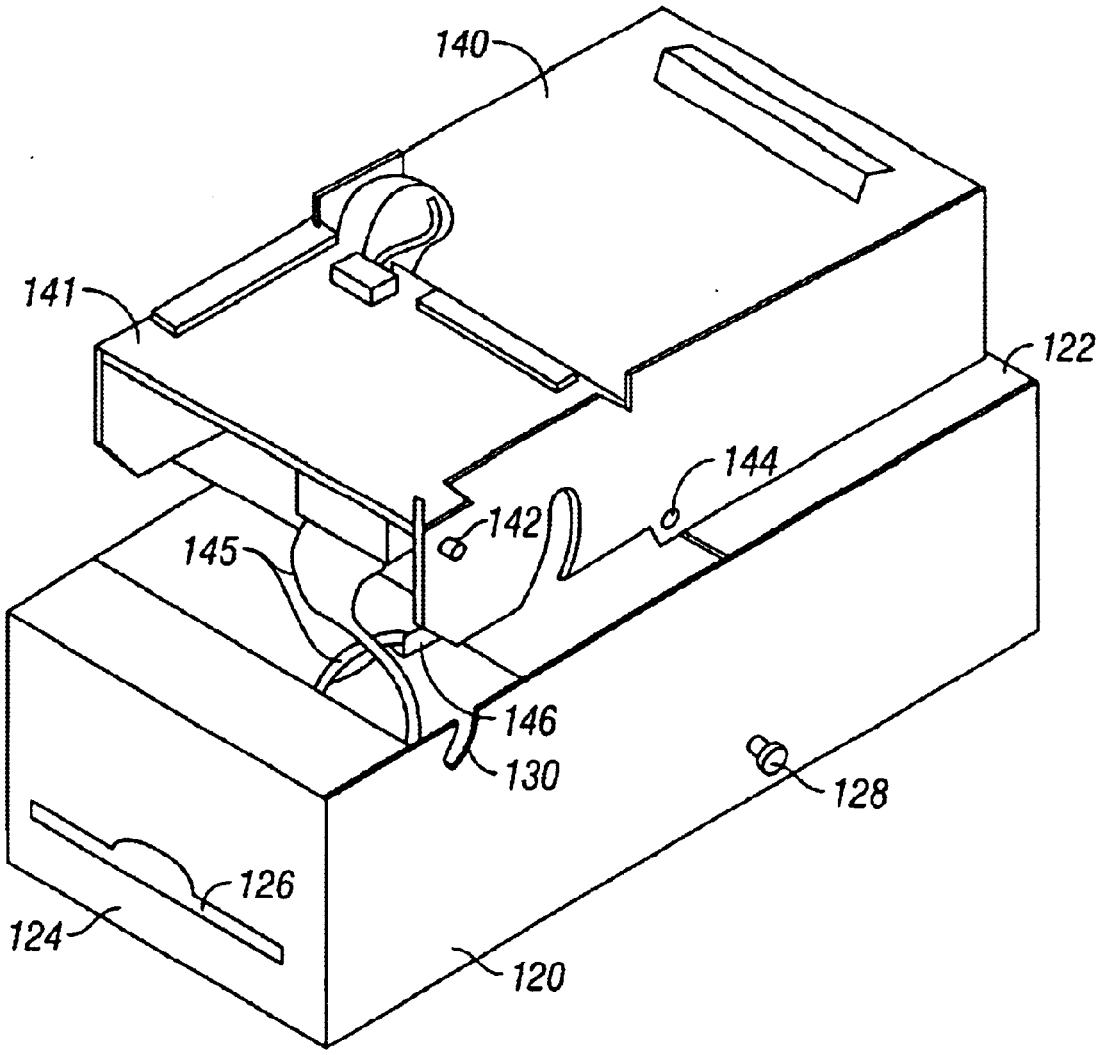
FIG. 3 is substantially a perspective view of the chassis and printer of the present invention.

Referring now to FIGS. 2 and 3, printer assembly 51 comprises of printer 140 and chassis 120 is provided to contain printer 140 and chassis 120. Chassis 120 comprises cavity 122, bezel 124, ticket opening 126, lock pin 128, and groove 130. Chassis 120 is preferably formed from sheet metal. Chassis 120 could be formed from plastic or other materials, if desired.

In the preferred embodiment, printer 140 includes a controller 141, a pin 142, hole 114, power cable 145, and data cable 146. As seen in FIG. 3, printer 140 fits into cavity 122 and may be attached to chassis 120 by pin 142 and groove 130. Pin 142 engages groove 130 and the groove guides printer 140 down into its proper position. A lock pin 128, such as a spring biased pin may engage hole 144 to lock printer 140 into chassis 120. Cable 145 may be used to transmit electrical power to printer 140 from device 10. Cable 146 may be used to transmit and receive communication signals to other devices. Connectors may be provided on ends of the cable to facilitate installation and removal. Printer 140 is preferably a Series 700 printer assembly available from Transact Technologies, Inc., of Wallingford, Conn. However, a large variety of other printers may also be used. It is understood that printer 140 may imprint ink or similar dye onto media 92. It may change a property of the media to create visible characters (e.g., heating the media).

It may also form holes through the media to render it machine readable, or it may code magnetic information onto a magnetic strip or the like on the media. A large variety of information may be printed on the media and the information may be presented in a number of different ways. For example, the information may be relevant to financial transactions, games, coupons, and prizes, and the information may be presented in alphabetical or numerical characters and symbols. During operation of the printer, media 92 is pulled by printer 140 from media holder 90 and guided into printer 140. After printing, media 92 is advanced to ticket opening 126 where the media is presented to a user.

Printer controller 141 is provided for controlling printer 140. Controller 141 may be mechanical or electronic depending on the type of printer. Controller 141 may perform other functions, such as controlling lights and communicating with other devices, such as a computer or gaming device.

Cover

Referring now to FIGS. 1 and 2, a cover 170 is shown. Cover 170 provides an aesthetically pleasing appearance while at the same time covering printer system 50 and opening 22. Cover 170 may have a flange 172 extending all around. Flange 172 abuts against slant top surface 19 when the printer assembly is in a closed position. Closed position means that printer system 50 is substantially attached to device 10 wherein opening 22 is covered. Closed position also means printer system 50 is in its normal operating position. Cover 170 may be formed from sheet metal or injection molded plastic. If desired, a gasket may be placed on flange 172 as a seal between slant top surface 19 and flange 172. Bezel 124 extends into an opening in cover 170. Bezel 124 provides an attractive appearance to users and limits access to ticket opening 126. A user would insert the user's fingers adjacent ticket opening 126 to grasp printed media 92 for removal. It has been found that presenting approximately one-half inch of media 92 to a user substantially reduces the likelihood that a user will prematurely grasp and pull the media. This reduces the chance that a ticket will be printed incorrectly. A pair of overlapping rails 160 may be used to connect cover 170 to chassis 120. Rail 160 has one end mounted to chassis 120 and another end mounted to cover 170. Rails 160 may be formed from sheet metal. Rail 160 may be attached to chassis 120 by welding or by a fastener. Rail 160 may be attached to cover 170 by a pin on the cover that slides into a slot on the rail or by a fastener. A screw 162 is used to connect the two rails together. Cover 170 may be removed from chassis 120 by removing screw 162 and by pivoting cover 170 away from chassis 120.

Media Holder

Figure 4:
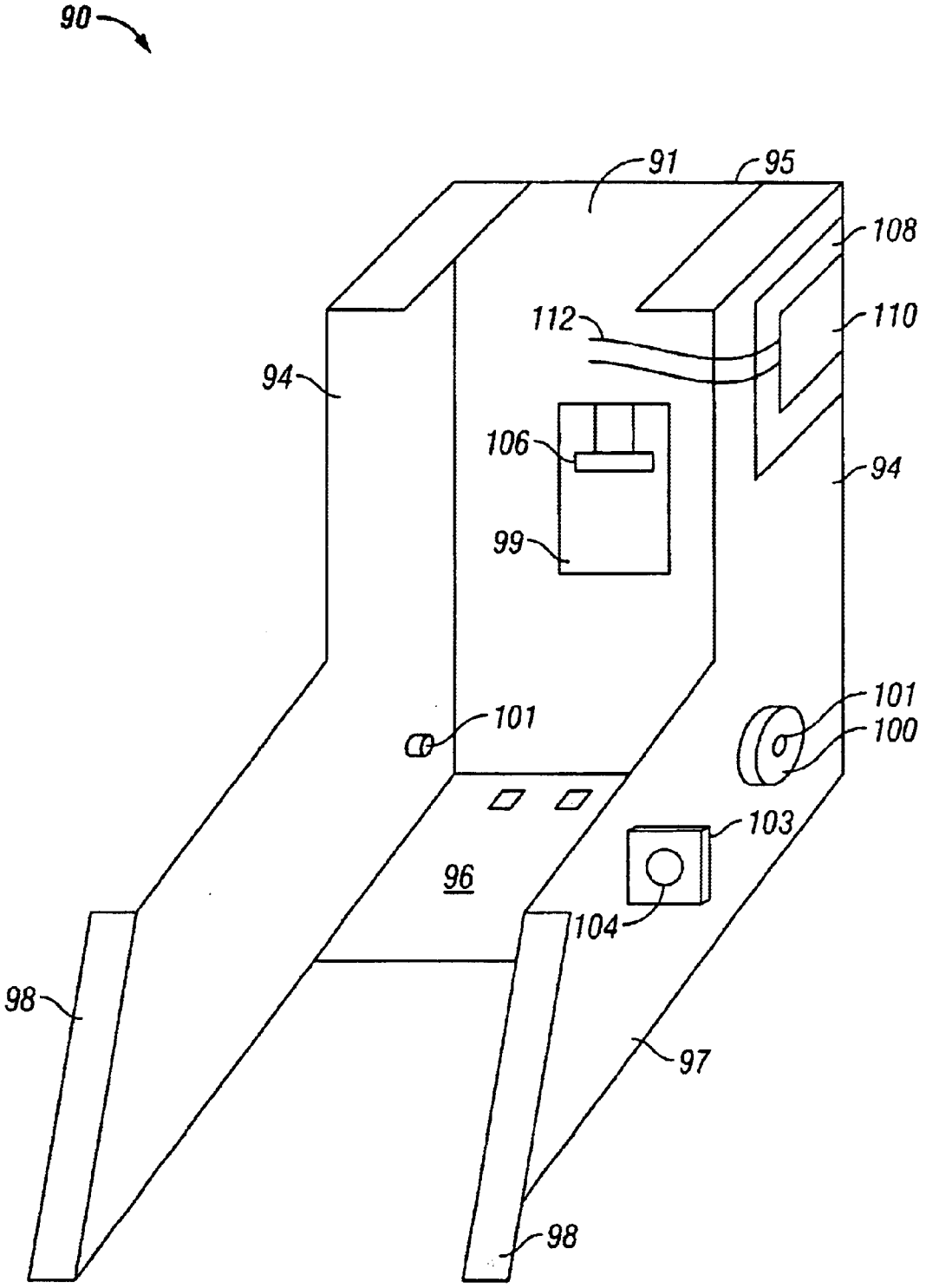
FIG. 4 is substantially a perspective view of one embodiment of the media holder of the present invention.

Referring now to FIGS. 2 and 4, one embodiment of media holder 90 is shown. Media holder 90 comprises flanges 98. Flanges 98 are attached to chassis 120 either by welding or by other fastening methods.

Media holder 90 is adapted to hold and store a printable media 92 prior to printing. Media 92 is adapted to be printed on by printer 140 and separated into individual pieces. Media 92 is flexible enough to be thread through the printer of the present invention. Once printed and separated, individual pieces of media may be used as tickets, vouchers, coupons, and other information carrying objects. In the preferred embodiment, media 92 is fan-folded. Media 92 may also be rolled, in which case, means is provided for holding a roll of media and unrolling it to dispense the media. Fan folded media, however, has the advantage of producing relatively flat vouchers and occupying less space in the presently preferred embodiment. Media 92 may be made by a number of different manufacturers including Lottery Impressions, Inc. of Waterford, Mich.

Media holder 90 comprises a pair of parallel side walls 94 having a back wall 95 and a bottom wall 96 therebetween. Walls 94, 95, and 96 form a substantial enclosure to hold fan-folded media 92. Walls 94, 95, and 96 also define cavity 91. Media holder 90 may be formed from sheet metal. Media 92 resides in cavity 91. Side walls 94 extend toward ends 97. A pair of flanges 98 may be formed on ends 97. An opening 99 may be formed in back wall 95. A lock arm 105 (FIG. 2) extends away from back wall 95 above opening 99. A lock mechanism 106 may be attached to lock arm 105. Lock mechanism 106 secures printer assembly 51 to support frame 52 in a closed position. Lock mechanism 106 is preferably a spring biased pin that engages hole 65.

Media holder 90 further comprises a shaft 101 attached to each side wall 94. Shaft 101 may be welded or swaged into an aperture in order to connect shaft 101 to wall 94. A roller 100 is mounted to and rotates on shaft 101. Roller 100 fits into and engages glide slot 60. Roller 100, shaft 101, and slot 60 allow printer assembly 51 to be slid along glide rail 58 when the printer assembly is extended from support frame 52. In the extended position, shaft 101 rests against glide rail end 59. One or more latch pins 102 may be located on the lower side of bottom wall 96. Latch pin 102 engages latch aperture 66 on support frame 52 in order to prevent printer assembly 51 from sliding back into the support frame after the printer assembly has been extended. After extending printer assembly 51 from support frame 52 to the point where shaft 101 contacts glide rail end 59, it is necessary to rotate the printer assembly downward in order for latch pin 102 to engage latch aperture 66. Printer assembly 51 can rotate about the shaft 101 approximately 30 degrees.

Media holder 90 may further comprise an opening 108 in wall 94. A sensor 110 may be mounted in opening 108 to sense the presence or absence of media 92. Sensor 110 may be configured to sense a low level of media 92 and turn on a light or another indicator on printer 140. Sensor 110 may be a conventional proximity sensor or other type of sensor. One or more wires 112 are connected between sensor 110 and printer 140. Wires 112 are used to carry an electrical signal from sensor 110 to printer 140.

Figure 7:
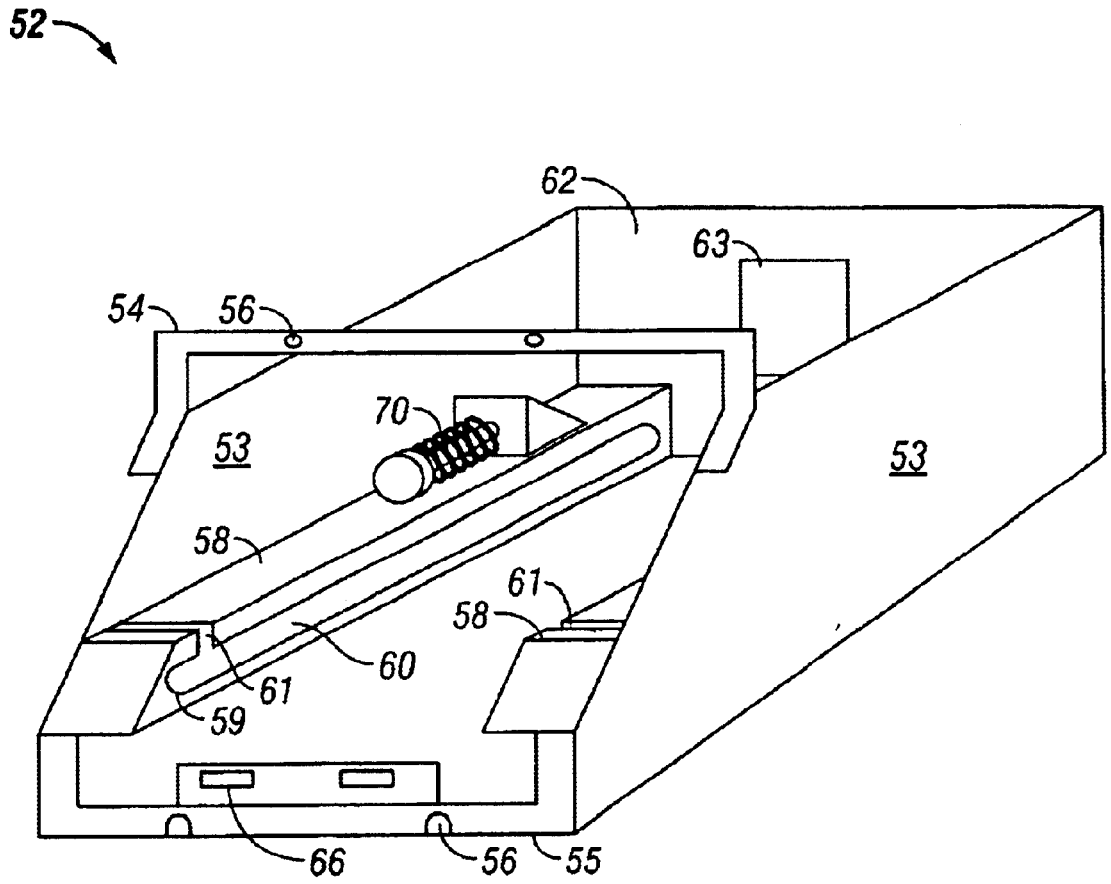
FIG. 7 is substantially a perspective view of one embodiment of the support frame of the present invention.
Figure 8:
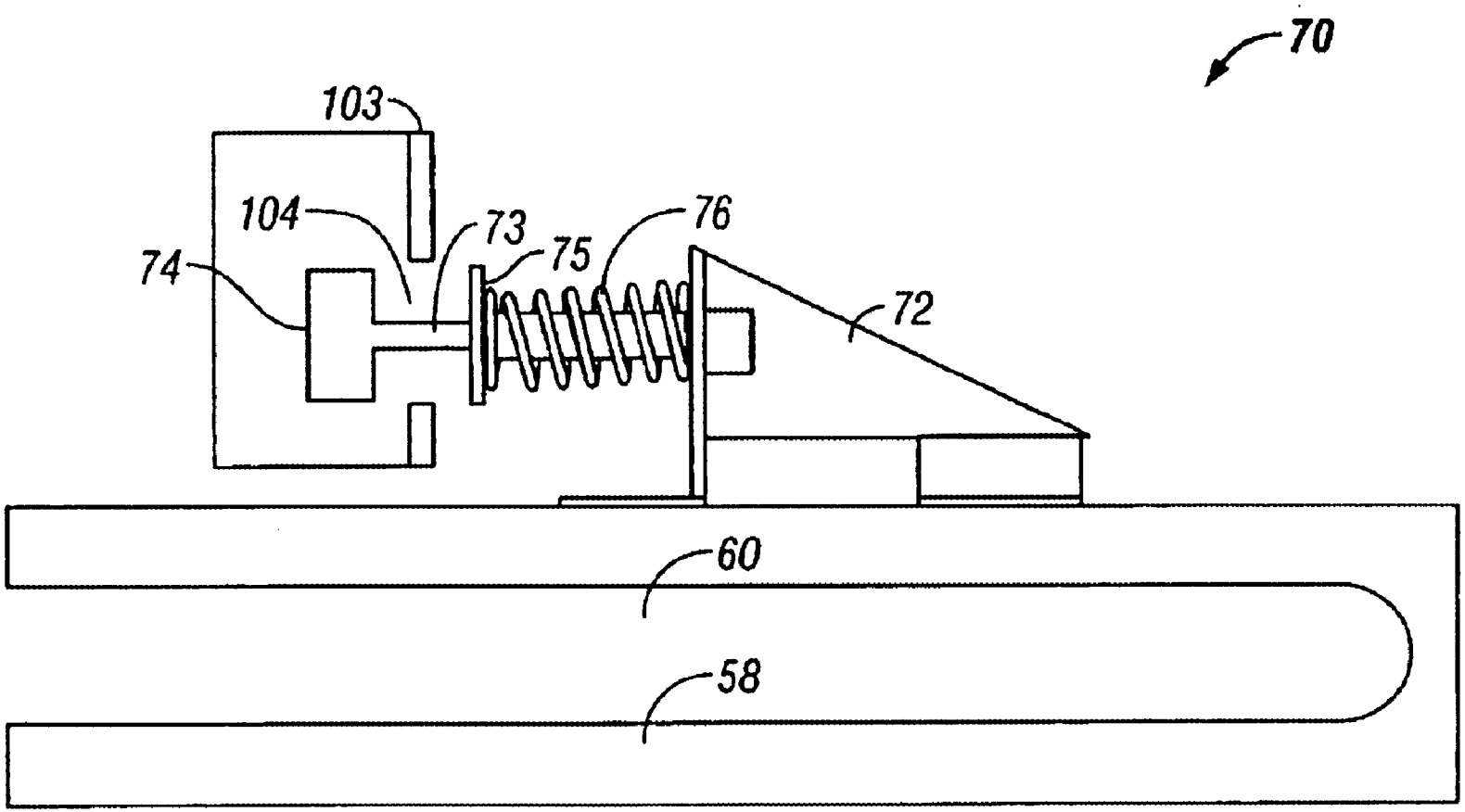
FIG. 8 is substantially a partial elevational view of the inside of the support frame of FIG. 7 showing details of the spring mechanism.

Referring now to FIGS. 7 and 8, a spring tab 103 may be added to media holder 90 on wall 94. Spring tab 103 may be welded to wall 94. A hole 104 passes through spring tab 103. Spring mechanism 70 engages spring tab 103 after lock mechanism 106 is released in order to prevent printer assembly 51 from being pushed too far out of support frame 52. When printer assembly 51 is in the closed position, and lock mechanism 106 is engaged, spring tab 103 rests adjacent washer 75 and compresses spring 76. In this position, head 74 extends through hole 104.

The pin can be disengaged by pulling the pin downward. Once disengaged, printer assembly 51 may be slid outwardly from support frame 52 for access to media holder 90 and printer 140.

Figure 5:
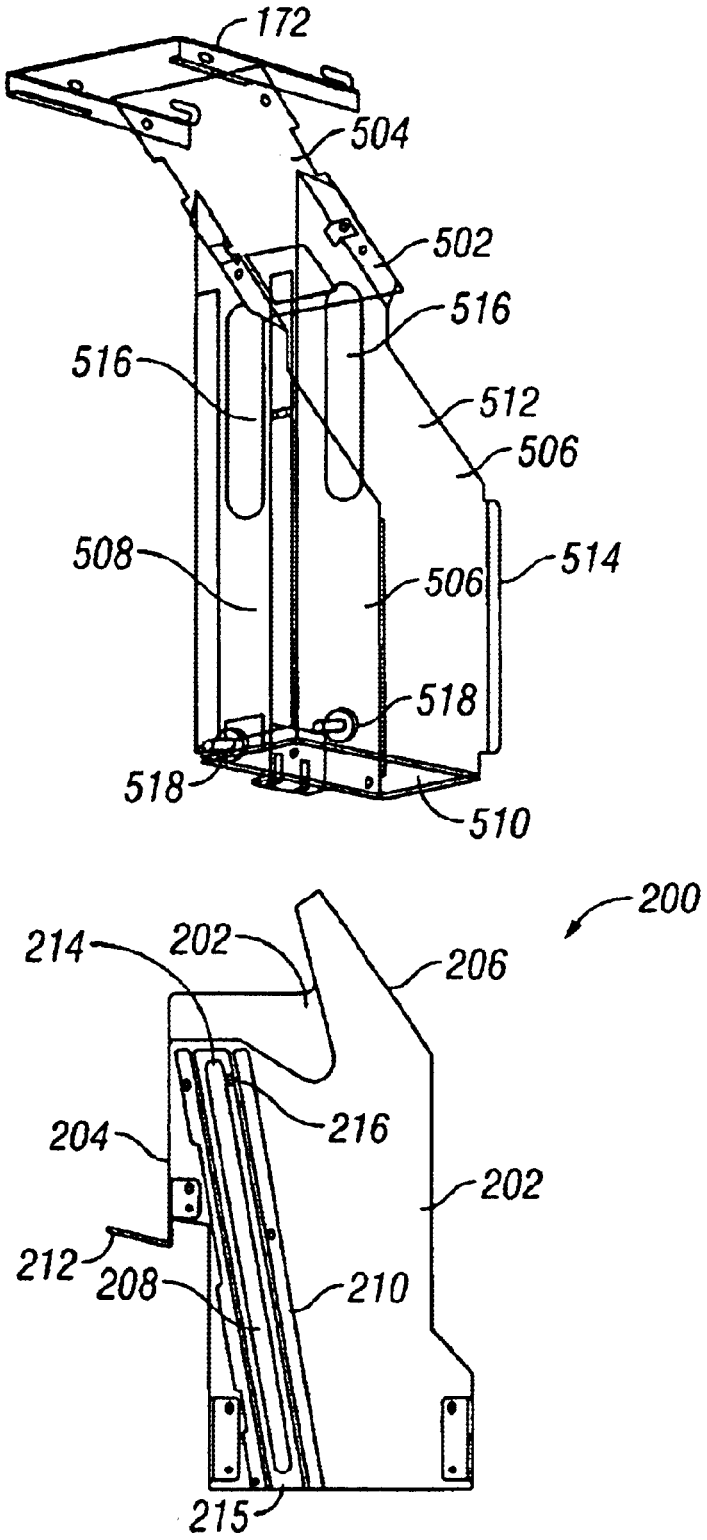
FIG. 5 is substantially a perspective view of different embodiments of the media holder and the support frame of the present invention.
Figure 6:
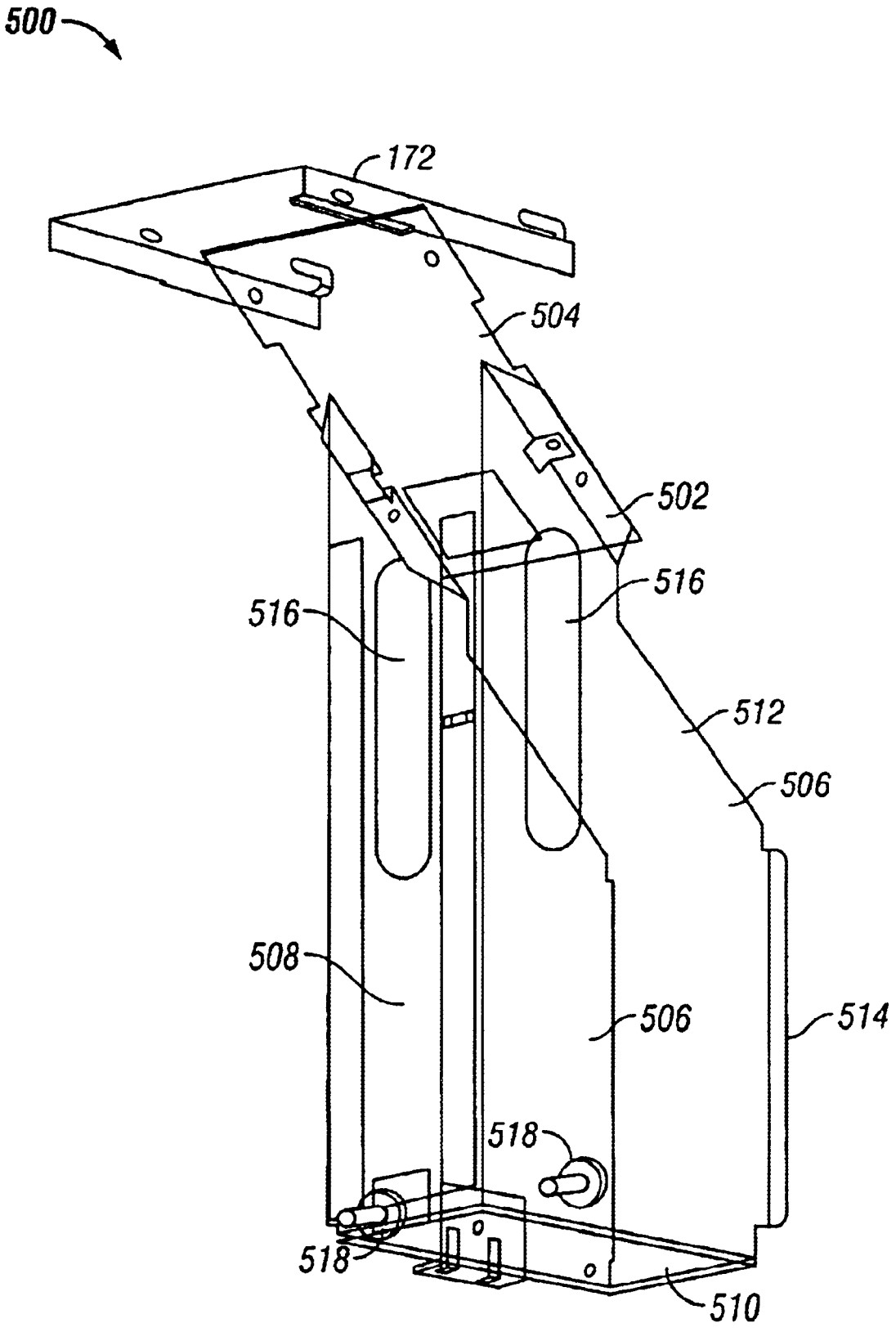
FIG. 6 is substantially a perspective view of the media holder shown in FIG. 5.

Referring now to FIGS. 5 and 6, another embodiment of media holder 500 is shown. Media holder 500 comprises flanges 502. Flanges 502 are attached to mounting plate 504 on which chassis 120 is mounted. Flanges 502 may be attached to the media holder 504 by welding, by conventional fasteners, or it may be molded with media holder 504. Mounting plate 504 is attached to flanges by using conventional fasteners, preferably screws.

Media holder 500 forms a substantially rectangular enclosure to allow it to hold fan-folded media 92. Media holder 500 comprises a pair of parallel side walls 506 having a back wall 508 and a bottom wall 510 there between. A cavity 512 is formed by walls 506, 508, and 510. Media holder 500 may be formed from sheet metal. Openings 516 may be formed on the sidewalls 506. Openings 516 may be used to allow a user to access media 92 inside cavity 512.

Figure 9:
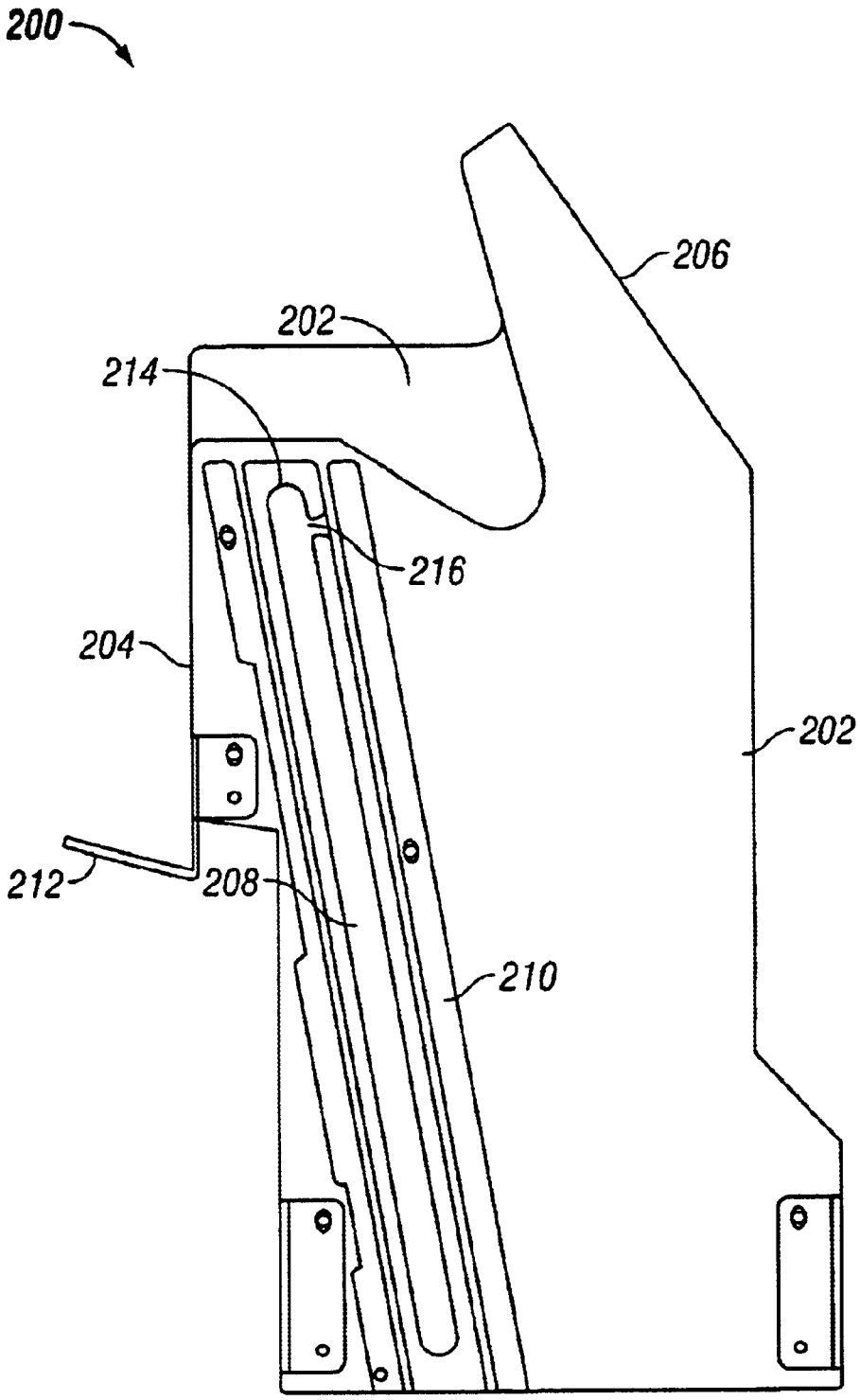
FIG. 9 is substantially a perspective view of the support frame shown in FIG. 5.

Media holder 500 further comprises a roller 518 attached to each of sidewall 94. Roller 518 may be attached using screws or fasteners known in the art. Referring now to FIG. 9, roller 500 fits into and engages glide slot 208 of support frame 200. Roller 500 and slot 208 allows printer assembly (not shown) to be slid along glide rail 210 when the printer assembly is extended from support frame 200.

Support Frame

Referring now to FIGS. 2 and 7, one embodiment of support frame 52 is shown. Support frame 52 comprises a pair of planar parallel sidewall 53 and a back wall 62 that joins sidewall 53. Support frame 52 may be formed from sheet metal. An upper mounting flange 54 and a lower mounting flange 55 are mounted at ends of sidewall 53. Flanges 54 and 55 can be spot welded to sidewall 53 or affixed with fasteners. Several threaded fasteners 56 may extend from flanges 54 and 55. Threaded fasteners 56 may be welded to flanges 54 and 55. Threaded fasteners 56 are used to attach support frame 52 to slant top surface 19. Threaded fasteners 56 may pass through apertures (not shown) in slant top surface 19 and be retained by conventional nuts (not shown). A pair of latch apertures 66 may be formed in lower mounting flange 55. Latch apertures 66 are used in conjunction with latch pin 102 for holding printer system 50 in an open position after it has been partially slid out of support frame 52. Open position means printer 50 is substantially extended away from slant top surface 19 such that hole 22 is at least partially open.

A pair of glide rails 58 may be provided to allow the printer system 50 to be easily slid into and out of support frame 52. Glide rails 58 are attached to side wall 53 and have a glide slot 60 extending between entry end 59 and stopping end 67. Glide rail 58 may be provided with a gap 61 located near entry end 59. Gap 61 allows printer assembly 51 to be completely removed from support frame 52 for access to the printer and media path. An opening 63 is formed in back wall 62. A lock arm 64 (FIG. 2) extends away from back wall 62 above opening 63. Lock arm 64 has a lock hole 65 passing therethrough.

A spring mechanism 70 may be mounted to glide rail 58 (also shown in FIG. 8). Spring mechanism 70 urges the printer assembly 51 away from support frame 52. Spring mechanism 70 comprises a spring support 72, a rod 73, a head 74, a washer 75, and a spring 76. Spring support 72 may be welded to glide rail 58. Rod 73 may be attached to support 72 by welding or with a conventional fastener. Washer 75 and spring 76 are retained on rod 73 between head 74 and spring support 72.

Referring now to FIGS. 5 and 9, another embodiment of support frame 200 is shown. Support frame 200 comprises a pair of planar parallel side wall 202 and a back wall 204 that joins side wall 202. Support frame 52 may be formed from sheet metal. Support frame 200 may be attached to case 12 by mounting arm 212 to case 12 with fasteners known in the art. Mounting surface 206 may also be attached to slant top surface 19 using fasteners known in the art.

A pair of glide rails 210 may be provided to allow the printer system 50 to be easily slid into and out of support frame 200. Glide rails 210 are attached to side wall 53 and have a glide slot 208 extending between entry end 214 and stopping end 215. Glide rail 210 may be provided with a gap 216 located near entry end 214. Gap 61 allows printer system 50 to be completely removed from support frame 200 for access to the printer and media path.

Methods of Use

Figure 10:
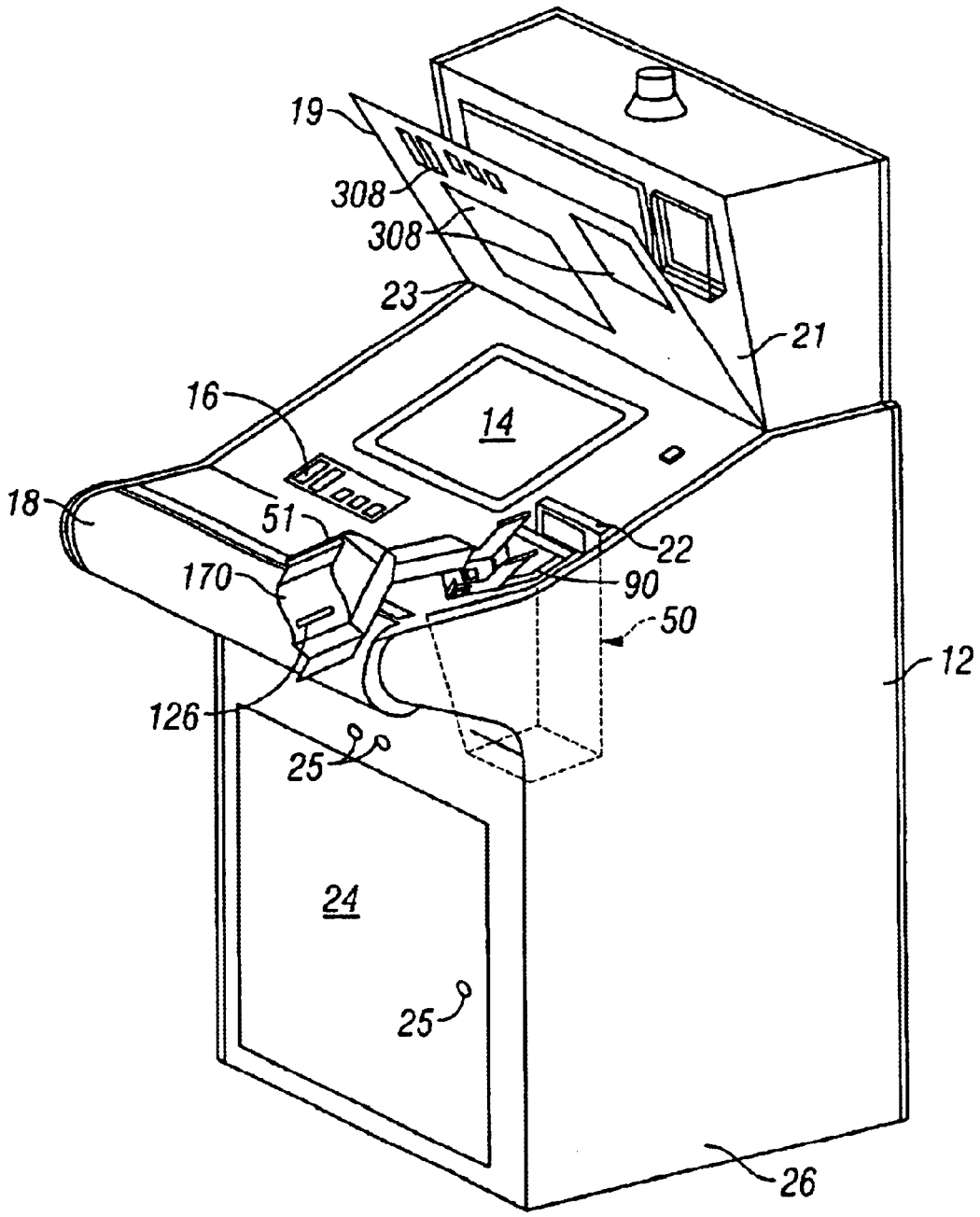
FIG. 10 is substantially a perspective view of the printer assembly of the present invention in use with an alternative embodiment gaming device in which the top opens.
Figure 11:
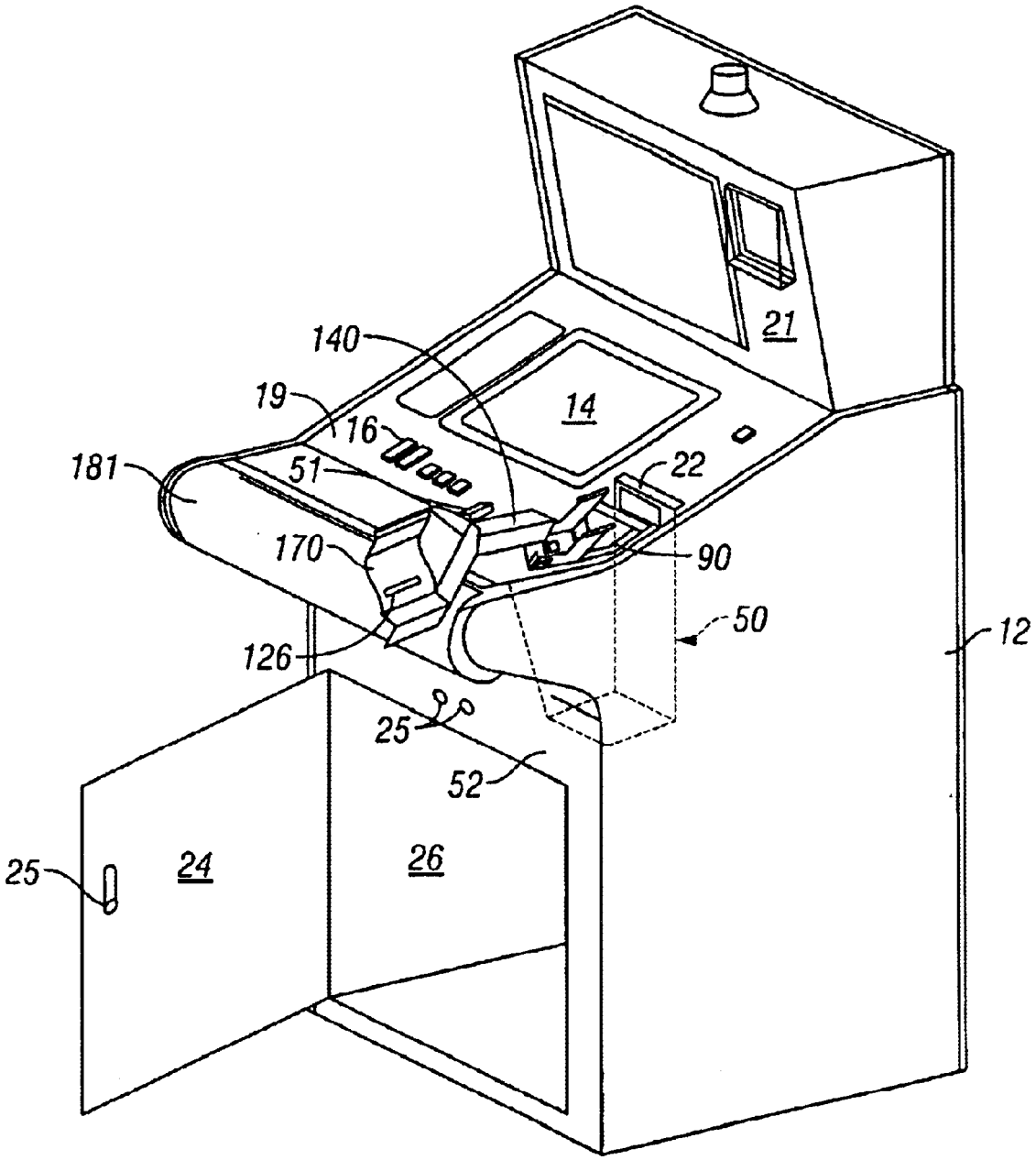
FIG. 11 is substantially a perspective view of the printer assembly of the present invention in use with a gaming device having a compartment door open and the printer system in an open position.

Printer system 50 is shown in closed position in FIG. 1. Referring now to FIG. 10, printer system 50 is moved from closed position to an open position as shown. Locking mechanism 25 is activated to unlock slant top surface 19. Slant top surface 19 is lifted upwardly away from display 14. In alternative operation, a technician would access printer system 50 in device 10 by unlocking lock 25 and opening door 24, as shown in FIG. 11. Referring to FIGS. 2 and 11, lock mechanism 106 is activated to allow printer assembly 51 to be slid away from support frame 52. Lock mechanism 106 may be activated by pulling a spring biased pin downward to disengage pin from hole 65. Spring 76 pushes on spring tab 103 which urges printer assembly 51 away from support frame 52. As the printer assembly 51 moves away from support frame 52, spring tab 103 will abut against head 74 stopping the travel of printer assembly 51. In order for the printer assembly to be further removed from the frame, it is necessary to tilt or slightly rotate printer assembly 51 upwardly relative to the support frame. When the printer assembly is rotated slightly upward, hole 104 is aligned with head 74 allowing spring tab 103 to pass over head 74.

The technician now further slides the printer assembly outward by grasping and pulling cover 170. As printer assembly 51 is sliding outwardly, shaft 101 is sliding in slot 60. When the printer assembly reaches the extended position, glide rail entry end 59 stops shaft 101. The technician then rotates printer assembly 51 slightly downward. This allows latch pins 102 to engage latch aperture 66 on support frame 52 in order to prevent the printer assembly from sliding back into the support frame after the printer assembly has been extended. In the open position, cover 170 rests on armrest 18. In this position, the media holder 90 and printer 140 are accessible for service and addition of media.

From the extended position, the entire printer assembly may be removed by rotating printer assembly 51 upwardly to remove latch pin 102 from latch aperture 66. Next, the printer assembly 51 is slid back toward the support frame 52 until shaft 101 is aligned with gap 61. At this point, the printer assembly may be lifted upward with shaft 101 passing through gap 61. The printer assembly 51 is now removed from support frame 52.

The technician would perform the steps for removal in reverse order in order to reinsert the printer assembly into support frame 52. As the printer assembly is slid back into support frame 52, spring tab 103 engages washer 75 and compresses spring 76. The technician then presses further on cover 70 until the spring biased pin of lock mechanism 106 snaps into hole 65 locking printer assembly 51 in the closed position. The door 24 may then be closed and locked securing the printer system.

Figure 12:
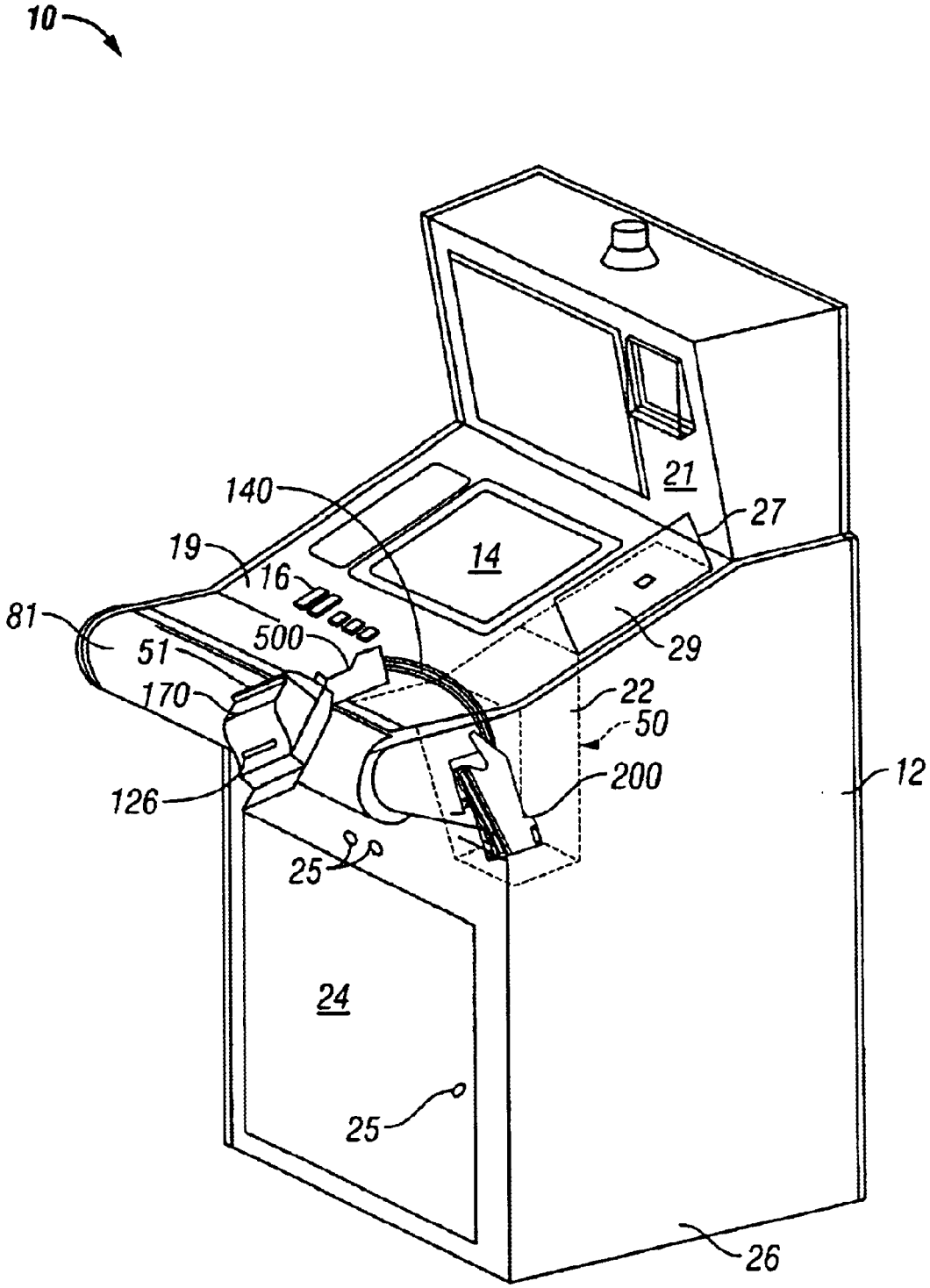
FIG. 12 is substantially a perspective view of another embodiment of the printer assembly of the present invention in use with an alternative embodiment gaming device in which a bill validator door opens.

FIG. 12 shows the preferred embodiment for using the present invention. Locking mechanism 25 is activated to unlock bill validator 27. Bill validator 27 is extended upwardly away from case 12. If user desires, slant top surface 19 may also be unlocked and opened to have more room to operate. User pulls flange 172 upwardly away from case 12. As user pulls flange 172 upwardly away from case 12, roller 518 glides through glide slot 208 up to glide rail end 214. Cover 170 is allowed to rest on armrest 18 so that media holder 90 and printer 140 are accessible for service and addition of media.

From extended position, the entire printer assembly 50 including media holder 500 may be removed by slightly pushing printer assembly downwards up to gap 216. Once rollers 518 reach gap 216, user pulls printer assembly upwards to disengage rollers 518 from glide slot 208. Once roller 518 is disengaged from glide slot 208, printer assembly 50 is removed from support frame 200. User would perform steps for removal in reverse order to reinsert printer assembly 50 and media holder 500 into support frame 200.

An advantage of printer assembly 50 is to fully expose the path of media 92. By removing the printer assembly 51 from support frame 52, 200, a technician can see the entire path of media. Thus, the technician can easily clear jams and remove debris from the media path. Another advantage of printer assembly 51 and support frame 52, 200 is that it readily replaces a coin box in a gaming device or other currency dispensing device. One of the advantages of providing printer system 50 is improved serviceability. In the preferred embodiment printer assembly 51 includes all of the printing parts and media. Therefore, if a problem develops with assembly 51, a technician need only remove the non-working printer assembly and replace it with a working printer assembly. The malfunctioning assembly may then be taken to a repair shop where it can be efficiently diagnosed and repaired. This results in a minimum amount of down time when a problem develops. Printer system 50 also allows a gaming device 10 to be converted from a device that handles cash or coins to a cashless device by replacing the coin box.

CONCLUSION

The present invention solves many of the problems associated with the prior art. The present invention provides a printer system for gaming devices that is accessible for service and yet is readily secured. The present invention provides a printer system that can have additional media to print on added easily and quickly. The present invention provides a printer system for a device that can be quickly replaced in the event of a failure to minimize down time of the device.

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A device comprising:

(A) a top surface positioned at an acute angle relative to a floor when the top surface is in an operating position;

(B) a secure compartment, at least a portion of the secure compartment defining a cavity, an opening in the top surface providing access to the cavity; and (C) a printer system comprising:

(a) a support frame, the support frame being positioned in the secure compartment, the support frame being attachable to the device, the support frame comprising at least one glide rail attached to the support frame; and (b) a printer assembly attached to the support frame, the printer assembly comprising:

(i) a media holder, the media holder being adapted to hold printable media;

(ii) a chassis intermediate and attached to the media holder; and (iii) a printer attached to the chassis, the printer being adapted to print on the media; wherein in a first position the printer assembly is positioned substantially inside the secure compartment, wherein in a second position the printer assembly is extended at least partially out of the secure compartment through the opening in the top surface.

2. The device according to claim 1, wherein the device is a slant top gaming device.

3. The device according to claim 1, wherein the device is an automated teller machine.

4. The device according to claim 2, wherein the printer system replaces a coin box of the gaming device.

5. The device of claim 1, wherein the printer assembly is slidably attached to the support frame.

6. The device of claim 1, wherein the printer assembly is removably attached to the support frame.

7. The device of claim 1, further comprising a roller attached to the media holder, the roller being retained by the glide rail, wherein when the printer assembly is moved from the first position to the second position, the roller travels on the glide rail.

8. The device of claim 1, wherein the printer assembly is movable to a third position in which the printer assembly is completely removed from the support frame.

9. The device of claim 8, wherein the glide rail comprises a gap formed therein, a roller passing through the gap when the printer assembly is moved to the third position.

10. The device of claim 1, wherein the media holder is accessible for the addition of media when the printer assembly is in the second position.

11. The device of claim 1, wherein the printer is removably attached to the chassis.

12. The device of claim 11, wherein the printer may be removed from the chassis when the printer assembly is in the second position.

13. The device of claim 1, further comprising a cover, the cover being attached to the chassis, the cover having an opening, the cover opening being adapted to allow the printable media to pass therethrough.

14. The device of claim 1, wherein the media holder comprises a latch pin that engages the support frame in the second position, the latch pin being configured to hold the printer assembly in the second position.

15. The device of claim 1, further comprising a locking mechanism, the locking mechanism being attached between the support frame and the media holder, the locking mechanism being adapted to lock the printer assembly to the support frame.

16. The device of claim 15, wherein the locking mechanism is accessed from a door on the device.

17. The device of claim 16, further comprising a spring mechanism attached to the support frame, the spring mechanism being adapted to urge the printer assembly away from the support frame when the locking mechanism is released.

18. The device of claim 17, further comprising a tab attached to the media holder, the tab being adapted to engage the spring mechanism after the locking mechanism is released, the tab also being adapted to prevent the spring mechanism from urging the printer assembly completely away from the support frame.

19. A method of situating a printer system comprising, but not necessarily in the order shown:

(A) positioning a support frame in a secure compartment of a device comprising a top surface positioned at an acute angle relative to a floor when the top surface is in an operating position, a portion of the secure compartment accessible from an opening formed in the top surface, the support frame comprising at least one glide rail, the glide rail having an entry end and a stopping end;

(B) providing a print assembly, the print assembly comprising a media holder, a chassis attached to the media holder, and a printer attached to the chassis;

(C) attaching the media holder to the glide rail of the support frame; and (D) placing the print assembly through the opening in the top surface and sliding the media holder from the entry end to the stopping end of the glide rail thereby allowing the print assembly to be situated substantially inside the secure compartment, wherein media from the media holder travels in a substantially vertical direction from holder to the printer and the print assembly remains movable away from the secure compartment by sliding the media holder from the stopping end to the entry end.

20. The method of claim 19, further comprising providing a gap formed within the glide rail and adjacent to the entry end of the glide rail, wherein the print assembly remains removeable from the support frame by sliding the media holder from the stopping end to the entry end and by allowing the media holder to exit out of the glide rail through the gap.

21. The method of claim 19, wherein the media holder remains accessible for adding media in the media holder by sliding the media holder from the stopping end to the entry end.

22. The method of claim 19, wherein the printer remains accessible for replacement by sliding the media holder from the stopping end to the entry end.

23. The method of claim 19, wherein the printer remains accessible for service by sliding the media holder from the stopping end to the entry end.

24. The method of claim 19, further comprising tilting the printer assembly toward the support frame such that a latch pin on the printer assembly engages the support frame.

25. The method of claim 19, further comprising:

(A) providing a cover attached to the chassis, the cover having an opening, the opening being adapted to allow media to pass therethrough; and (B) displacing the cover substantially outside the secure compartment of the device, wherein media is presented to a user from the cover opening.

* * * * *

UNITED STATES PATENT AND TRADEMARK OFFICE

CERTIFICATE OF CORRECTION

PATENT NO. : 6,857,804 B2
APPLICATION NO. : 10/090115
DATED : February 22, 2005
INVENTOR(S) : Robert A. Luciano, Jr. et al.

It is certified that error appears in the above-identified patent and that said Letters Patent is hereby corrected as shown below:

Column 1
In line 59, replace “Printer” with --The printer--

Column 2
In line 23, delete the second occurrence of the words “to the”

Column 3
In line 56, replace “with out” with --without--

Signed and Sealed this

Sixth Day of May, 2008

JON W. DUDAS
*Director of the United States Patent and Trademark Office*